United States Patent [19]

Abdoo

[11] 4,104,991

[45] Aug. 8, 1978

[54] CIRCUIT FOR CONTROLLING THE OPERABILITY OF ONE OR MORE CYLINDERS OF A MULTICYLINDER INTERNAL COMBUSTION ENGINE

[75] Inventor: Richard V. Abdoo, Livonia, Mich.

[73] Assignee: Ford Motor Company, Dearborn, Mich.

[21] Appl. No.: 716,865

[22] Filed: Aug. 23, 1976

[51] Int. Cl.[2] ..... F02B 3/00

[52] U.S. Cl. ..... 123/32 EA; 74/860; 123/90.11; 123/198 F

[58] Field of Search ..... 123/90.11, 198 F, 32 EA; 74/857, 860

[56] References Cited

U.S. PATENT DOCUMENTS

| | | | |
|---|---|---|---|
| 2,652,038 | 9/1953 | Winkler | 123/90.55 |
| 2,875,742 | 3/1959 | Dolza | 123/198 F |
| 3,645,366 | 2/1972 | Numazawa | 74/860 X |
| 3,756,205 | 9/1973 | Frost | 123/32 EA |
| 3,763,720 | 10/1973 | Aono et al. | 123/32 EA |
| 3,882,833 | 5/1975 | Longstaff et al. | 123/90.11 |
| 3,896,779 | 7/1975 | Omori et al. | 123/32 EA |
| 4,007,590 | 2/1977 | Nagai et al. | 123/32 EA |
| 4,024,850 | 5/1977 | Peter et al. | 123/198 F |
| 4,040,395 | 8/1977 | Demetrescu | 123/32 EA |

FOREIGN PATENT DOCUMENTS 158,751 12/1961 U.S.S.R. ..... 123/90.11

*Primary Examiner*—Charles J. Myhre
*Assistant Examiner*—Sheldon J. Richter
*Attorney, Agent, or Firm*—Robert W. Brown; Clifford L. Sadler

[57] ABSTRACT

Circuit for controlling the operability of one or more cylinders of a multicylinder internal combustion engine having electrically controllable means associated with it for preventing combustion from occurring in at least one cylinder of the engine. Preferably, the electrically controllable means for preventing combustion in a cylinder comprises a solenoid and associated mechanical means for preventing opening of the intake and exhaust valves for such cylinder to be thus disabled. Maintaining the intake and exhaust valves in a closed condition prevents the intake of an air-fuel mixture and permits compression and expansion, in a spring-like manner, of gases trapped within the combustion chamber. Electrical circuit means are provided for sensing a plurality of conditions of operation of the engine and logic circuit means, responsive to the sensing circuit means, are provided for controlling the actuation of the means for preventing combustion from occurring in the cylinder or cylinders selected for disablement.

5 Claims, 4 Drawing Figures

Voltage Supply, Signal Source And Logic Circuit
Engine Speed Responsive Switching Circuit
Output Circuit
>950 RPM
>1700 RPM
>38 mmHg
>229 mmHg
3rd Gear
+V
470Ω 1/2 W
120Ω 2W
100KΩ
47KΩ
110 KΩ
1N4738
1N4001
.1μf
.01μf
4.7μf
390μf

CIRCUIT FOR CONTROLLING THE OPERABILITY OF ONE OR MORE CYLINDERS OF A MULTICYLINDER INTERNAL COMBUSTION ENGINE

BACKGROUND

This invention relates to a circuit for controlling the operability of one or more cylinders of a multicylinder internal combustion engine. Prior art U.S. patents for accomplishing this purpose include Rohlin U.S. Pat. No. 2,166,968 issued July 25, 1939; Winkler U.S. Pat. No. 2,652,038 issued Sept. 15, 1953; Dolza U.S. Pat. No. 2,875,742 issued Mar. 3, 1959; and Mick U.S. Pat. No. 2,918,047 issued Dec. 22, 1959.

As the above patents indicate, it is known and desirable to increase the efficiency of a multicylinder internal combustion engine by reducing the number of cylinders on which the engine operates under predetermined engine operating conditions, particularly conditions of low engine load and under selected engine speed conditions. The above patents generally describe control systems for disabling a number of cylinders in a multicylinder internal combustion engine by suppressing the supply of fuel to certain cylinders or by preventing the operating of the intake and exhaust valves of selected cylinders. Under given engine speed and load conditions, the disablement of some of the cylinders of the engine increases the load on those remaining in operation and, as a result, the energy conversion efficiency is increased. The prior art systems, however, have been generally mechanically complex and quite expensive in practical implementation. The present invention obviates these difficulties of the prior art controls and permits a substantial improvement in fuel economy to be obtained in a multicylinder internal combustion engine equipped in accordance with the invention.

SUMMARY OF THE INVENTION

It is an object of the invention to provide a circuit for controlling the operability of one or more cylinders of a multicylinder internal combustion engine such that selected cylinders thereof may be disabled during the course of engine operation. This is accomplished through the use of electrically controlled means for preventing the occurrence of combustion in a selected cylinder or group of cylinders under predetermined conditions of engine operation. The conditions of engine operation are detected with electronic circuitry which, in turn, controls the electrically controllable means for preventing combustion from occurring in the selected cylinders. Only minimal modifications of conventional multicylinder internal combustion engines, such as those employed in a motor vehicle, are required in order to obtain the significant advantages of the invention.

The invention may be better understood by reference to the detailed description which follows and to the drawings.

BRIEF DESCRIPTION OF THE DRAWINGS

FIG. 4 is a schematic electrical diagram of an engine speed responsive switching circuit shown in block form in FIGS. 1 and 2.

DETAILED DESCRIPTION

Figure 1:
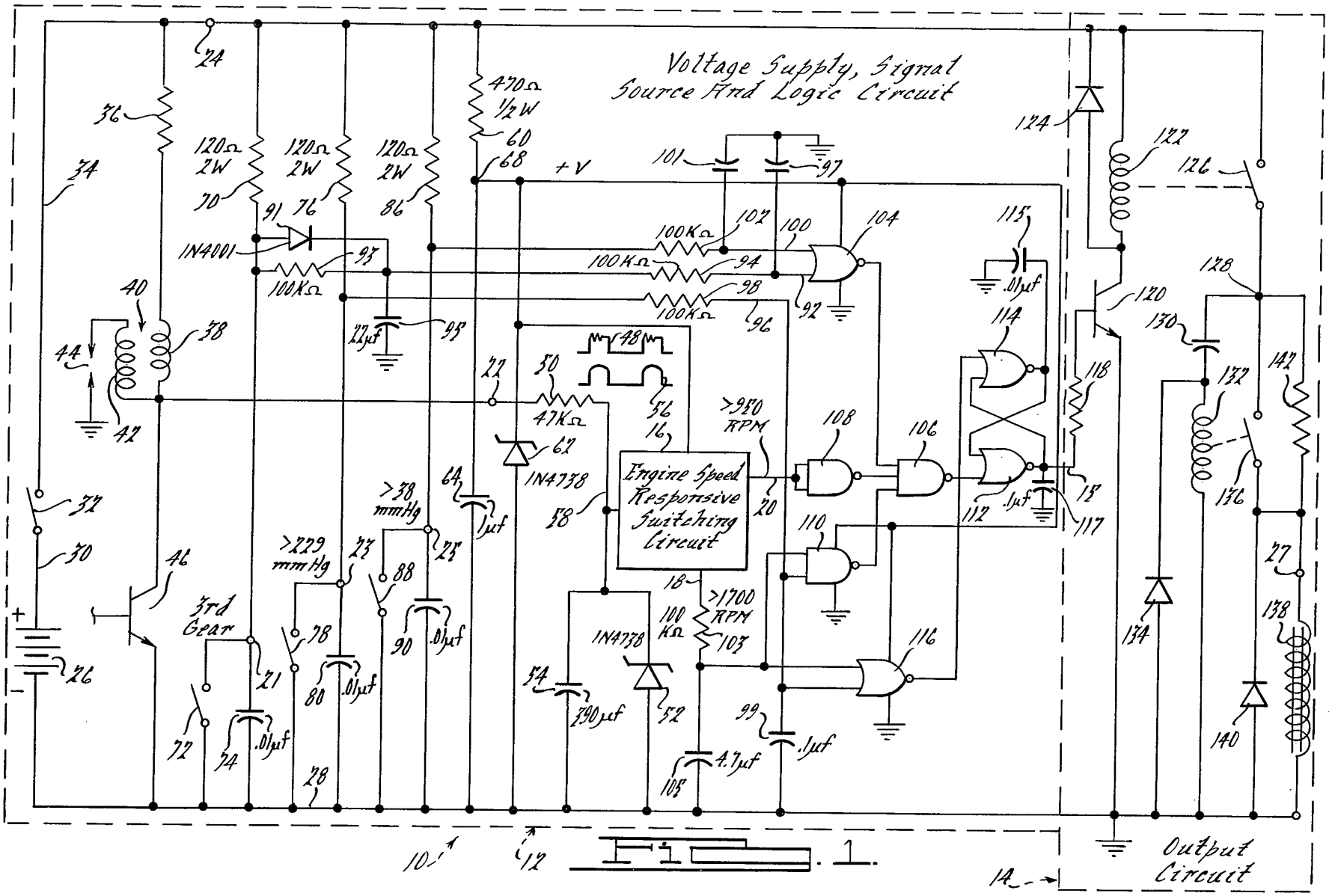
FIG. 1 is a schematic electrical diagram of a circuit for controlling the operability of one or more cylinders in a multicylinder internal combustion engine.

With reference now to the drawings, wherein like numerals refer to like items or devices in the several views, there is shown in FIG. 1 a circuit generally designated by the numeral 10 for controlling the operability of one or more cylinders of a multicylinder internal combustion engine. As specifically hereinafter described, the circuit 10 is considered to be applicable to a six cylinder spark-ignition internal combustion engine that has a specific three of its cylinders disabled under predetermined conditions of engine operation. The three cylinders disabled preferably are alternate cylinders in the engine firing order, and the engine is the prime mover in a motor vehicle.

The circuit 10 includes a voltage supply, signal source and logic circuit 12 and an output circuit 14, as is indicated by broken lines enclosing the circuit portions. The circuit 12 receives or generates, and responds to, various signals related to engine operation and, through a logic circuit included therein, produces either a logic zero level or a logic one level signal on an output lead 15 of the circuit 12. A logic one level signal on output lead 15 causes the output circuit 14, in a manner hereinafter described, to disable the selected three cylinders of the six cylinder engine. The circuit 12 includes an engine speed responsive switching circuit 16 having output leads 18 and 20. A logic zero level signal appears on output lead 18 when the engine speed is greater than a predetermined level, such as 1700 rpm as indicated in the drawings. Similarly, a logic zero level signal appears on output lead 20 of the switching circuit 16 when the engine rpm is above a second predetermined and lower rpm level, such as 950 rpm as indicated in the drawing.

Circuitry that preferably is utilized in generating the signal appearing upon output leads 18 and 20 is described in my concurrently filed and commonly assigned U.S. Pat. No. 4,081,694, filed Aug. 23, 1976 and entitled "Frequency Responsive Switching Circuit." However, the circuitry 16 also is described herein for purposes of providing complete disclosure of the best mode contemplated by the inventor for carrying out the present invention. The switching circuit 16 provides on the lead 18 a logic zero level signal when the engine speed increases above 1700 rpm and, through a hysteresis circuit, then reduces to 1500 rpm the point to which the engine speed must thereafter decrease in order to cause the signal on output lead 18 to return to a logic one level.

The function of the circuitry illustrated in FIG. 1 is as follows: the vehicle engine can be switched from six cylinder operation to three cylinder operation only if the engine intake manifold vacuum level is 229 millimeters of mercury (mm Hg) below atmospheric pressure, the engine rpm is greater than 1700 and the vehicle three-forward-gear transmission is in third gear; if, when the engine is operating on only three cylinders, the engine rpm should become not greater than 1500 and the manifold vacuum level should become less than 229 mm Hg, then the engine operation switches from three cylinders to six cylinders; and if, when the engine is operating on three cylinders, the intake manifold vacuum level should become less than 38 mm Hg or if the vehicle's transmission is placed in a condition other than third gear or if the engine rpm should become less than 950, then the engine switches from three cylinder operation to six cylinder operation. Otherwise stated, and if it is assumed that the vehicle's transmission is left in third gear, the engine is switched from six cylinder operation to three cylinder operation when the manifold vacuum level exceeds 229 mm Hg at a time that the engine speed exceeds 1700 rpm, and the engine remains in three cylinder operation unless the engine speed simultaneously is below 1500 rpm with a manifold vacuum level less than 229 mm Hg or unless the manifold vacuum level falls below 38 mm Hg or the engine rpm falls below 950. In third gear, 1700 rpm may correspond to a vehicle speed of, for example, 45 mph, 1500 rpm may correspond to a speed of 40 mph and 950 rpm may correspond to a speed of 25 mph.

Figures 2, 3:
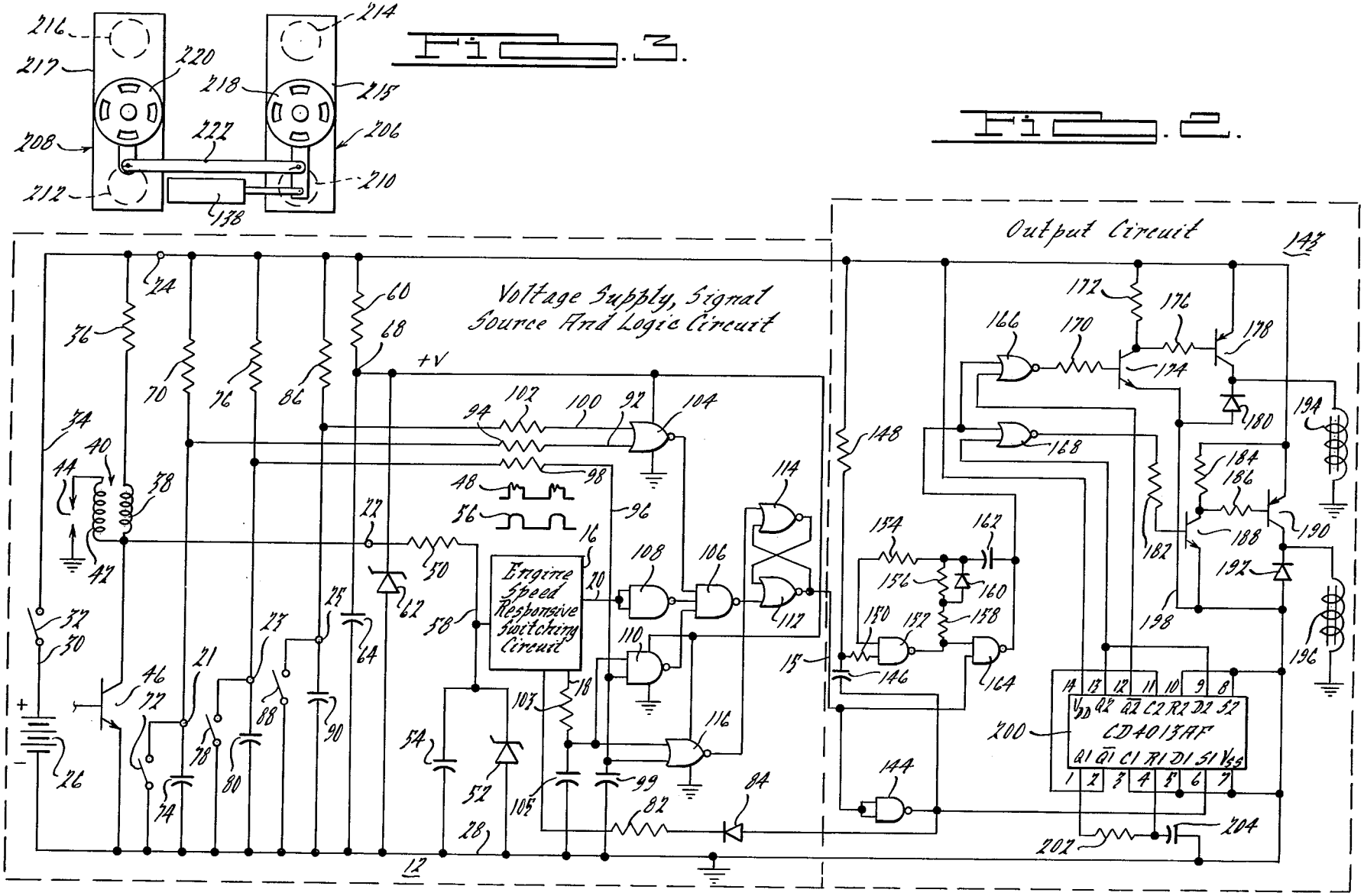
FIG. 2 is a schematic diagram similar to the circuit of FIG. 1, but including an output circuit capable of alternating the disablement of a selected first cylinder or group of cylinders and a selected second cylinder or group of cylinders each time during engine operation that operation with a reduced number of cylinders becomes desirous.
FIG. 3 is a diagrammatic view of electrically controllable means for disabling the intake and exhaust valves of a cylinder of an engine (not shown)
Figure 1:
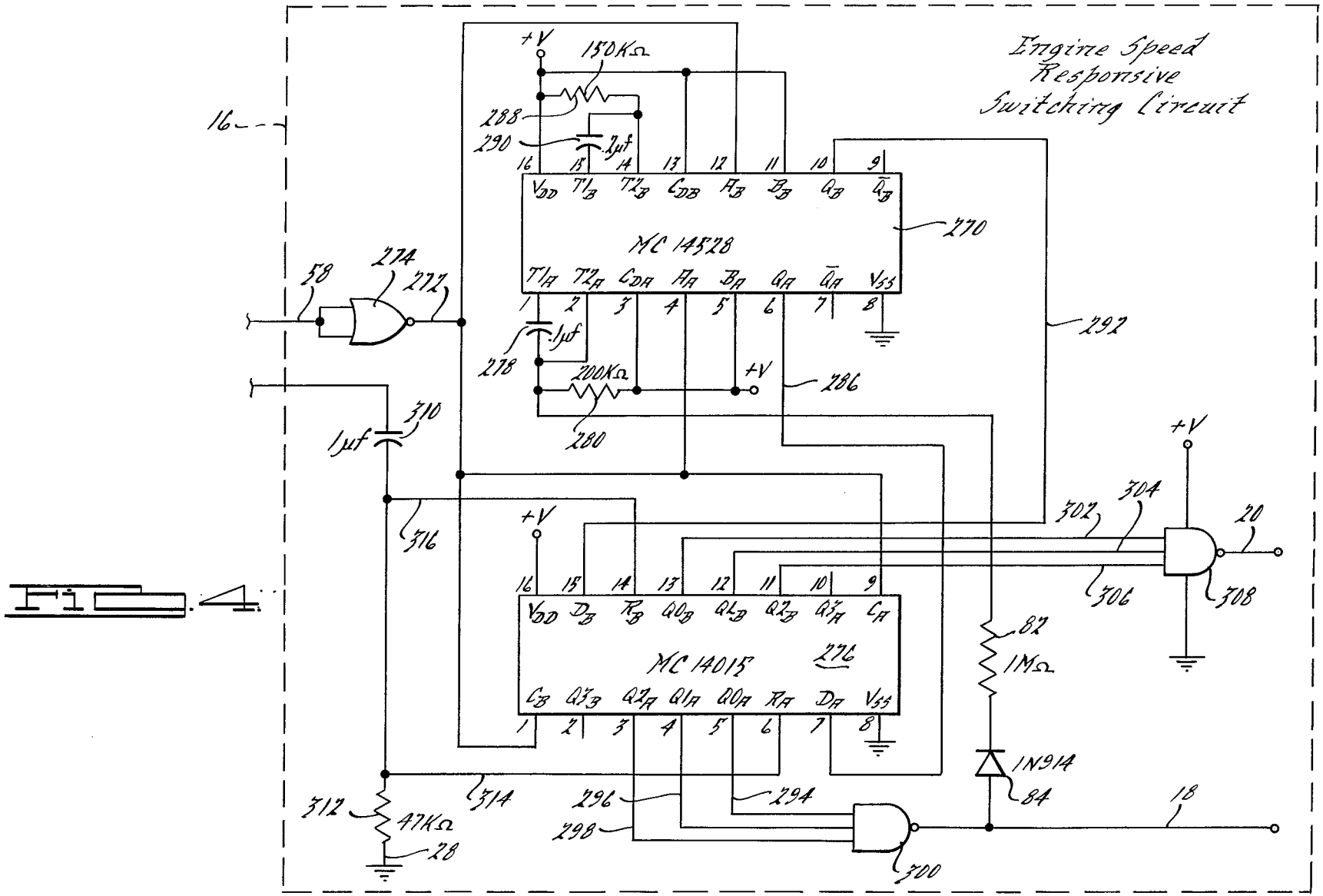

The operation of the circuitry illustrated in FIG. 2 is identical to that of FIG. 1 as described in the preceding paragraph with the exception that provision is made to alternate between two groups of three engine cylinders that are disabled. When the logic circuit in FIG. 2 indicates on the lead 15 that three engine cylinders are to be disabled, an output circuit illustrated in FIG. 2 causes a first group of three engine cylinders to be disabled while the second group of three cylinders continues to operate. After the engine has switched back to six cylinder operation and again the logic circuit indicates on lead 15 that three cylinder operation is desired, then the second group of three cylinders is disabled and the first group of three cylinders remains in operation. This variation of disablement of the first and second group of cylinders may provide more even wear in the engine.

With particular reference now to the circuit of FIG. 1, it may be seen that the voltage supply, signal source and logic circuit 12 includes some components that are conventionally associated with spark-ignition internal combustion engines in motor vehicles. Also, terminals 21, 23, 25, 22 and 25 may constitute input terminals to an electronic module having an output terminal 27 in the output circuit 14. The components exterior of the electronic module in the circuit 12 include a DC source of electrical energy 26, which preferably is a conventional 12-volt storage battery, having a negative lead connected at 28 to ground and having a positive lead 30 that is connected to one pole of an ignition switch 32. When the ignition switch 32 is closed, an unregulated voltage appears on lead 34 connected to the opposite pole of the ignition switch. The voltage on lead 34 is applied to input terminal 24 of the circuit 14 and also is applied through a resistor 36, to the primary winding 38 of an ignition coil 40 having a secondary winding 42 connected through a distributor (not shown) to the various spark gaps 44 formed between the electrodes of the engine spark plugs. The resistor 36, the primary winding 38, and the collector-emitter circuit of a transistor 46 are connected in series across the voltage supply leads 34 and 28. The transistor 46 is the output switching semiconductor device conventionally found in inductive, transistorized ignition systems now conventionally used in motor vehicles.

The junction between the collector of the transistor 46 and the primary winding 38 of the ignition coil is connected to the terminal 22 in the circuit 12. As the transistor 46 switches between conductive and nonconductive states during engine operation, the signal 48 appears at terminal 22. When the transistor 46 is conductive, the terminal 22 is at nearly ground potential, and, when the transistor 46 becomes non-conductive, the potential at terminal 22 stabilizes at the voltage on supply lead 34 after some ringing that occurs at the rise of the pulse. The ringing results from the inductive characteristics of the ignition system. The pulse repetition frequency of the signal 48 is directly proportional to engine speed.

A resistor 50 is connected in series with the parallel combination of a zener diode 52 and a capacitor 54. The zener diode 52 may have a reverse breakdown voltage of, for example, 10 volts and a signal 56, having the pulse repetition frequency of the signal 48, appears on the lead 58 connected to the engine speed responsive switching circuit 16.

The circuit 12 includes voltage regulation means in the form of a resistor 60 connected in series with the parallel combination of a zener diode 62 and a capacitor 64, these elements being connected across the supply voltage leads 34 and 28. As a result, a voltage +V that is regulated by the zener diode 62 and the filter capacitor 64 appears at the junction 68 formed between these components and the resistor 60. This regulated voltage is used to supply the switching circuit 16 and other components in the circuit 10.

Connected across the voltage supply leads 34 and 28 are the following: a resistor 70 connected in series with the parallel combination of a switch 72 and a capacitor 74; a resistor 76 connected in series with the parallel combination of a switch 78 and a capacitor 80; and a resistor 86 connected in series with the parallel combination of a switch 88 and a capacitor 90. The switch 72 is open when the vehicle's transmission is in a position other than third gear and is closed to provide a ground logic zero level signal at terminal 21 when the vehicle's transmission is in third gear. Thus, a logic zero level signal appears on a lead 92, coupled to a terminal 21 through a current-limiting resistor 94 and a time delay circuit, when the vehicle's transmission is in third gear. The switch 78 preferably is responsive to the engine's intake manifold vacuum level and is open when the manifold vacuum level is less than 229 mm Hg and is closed when the manifold vacuum level is greater than 229 mm Hg. Thus, a logic zero level signal appears on a lead 96, connected through a circuit-limiting resistor 98 to the terminal 23, when the manifold vacuum level is greater than 229 mm Hg. The switch 88 preferably is responsive to the engine's intake manifold vacuum level and is open when the manifold vacuum level is less than 38 mm Hg and is closed when the manifold vacuum level is greater than 38 mm Hg. Thus, when the manifold vacuum level exceeds 38 mm Hg, a logic zero level signal appears on lead 100, connected through a current-limiting resistor 102 to the terminal 25, when the manifold level is greater than 38 mm Hg.

Leads 92 and 100 form the inputs to a NOR-gate 104, the output lead of which forms one input to a NAND-gate 106. The center-input to the NAND-gate 106 is obtained from an inverter 108 whose input is the signal on lead 20. The third input to the NAND-gate 106 is obtained as the output of a NAND-gate 110 having a first input coupled to lead 18 and a second input connected to lead 96.

The output lead from the NAND-gate 106 forms one of two inputs to a NOR-gate 112 having the output lead 15. The second NOR-gate 114 has its output connected as the second input to the NOR-gate 112 and the output of NOR-gate 112 forms one of two inputs to the NOR-gate 114. Thus, NOR-gates 112 and 114 are connected as a crossed-output flip-flop. The second input to the NOR-gate 114 is obtained at the output of a NOR-gate 116 having two inputs, one of which is coupled to lead 18 and the other of which is connected to lead 96.

Output lead 15 from the circuit 12 is connected through a resistor 118 to the base of a transistor 120 whose emitter is collected to ground lead 28 and whose collector is connected through the parallel combination of a relay coil 122 and a field dissipation diode 124 to the voltage supply lead 34. Relay coil 122 controls normally open switch 126, one pole of which is connected to the voltage supply lead 34 and the other pole of which is connected to a junction 128. A capacitor 130 has one of its leads connected to junction 128 and has its other lead connected through the parallel combination of a relay coil 132 and a field dissipation diode 134 to the ground lead 28. Relay coil 132 controls a switch 136 having one of its poles connected to the junction 128 and having its other pole connected, through the parallel combination of a solenoid actuator 138 and a field dissipation diode 140, to the ground lead 28. A resistor 142 is connected in parallel with the switch 136.

With particular reference now to FIG. 3, it may be seen that the solenoid 138 has a movable arm which is connected to mechanisms 218 and 220 associated with the intake valve 206 and exhaust valve 208 assemblies for one of the cylinders in the internal combustion engine. FIG. 3 is a diagrammatic illustration of the valve disabler mechanism preferred for use in the present invention and may be commercially obtained from the Eaton Corporation which has a place of business in Southfield, Michigan. In FIG. 3, a push rod 210, controlled by the engine's camshaft, moves a rocker arm 15, which in turn causes the intake valve 214 to move provided the solenoid 138 is de-energized. In this case, the rocker arm 215 pivots about its center point in response to movement of the push rod 210. Similarly, when the solenoid 138 is de-energized, the push rod 212 associated with the exhaust valve 208 causes the rocker arm 217 to pivot about its center point to produce movement of exhaust valve 216.

Mechanisms 218 and 220 are caused to rotate approximately 45° when the solenoid 138 is energized. Linking member 222 is used to provide simultaneous rotation of both of the mechanisms 218 and 220 upon actuation of solenoid 138. When the mechanism 218 and 220 rotate, the pivot point for the rocker arms 215 and 217 shifts such that they then pivot about the ends of the valve stems 214 and 216. Thus, as the push rods 210 and 212 move in response to the rotation of the engine's camshaft, there is no movement of the valve stems 214 and 216 and, therefore, the intake and exhaust valves remain closed disabling the cylinder with which these valves are associated.

As illustrated in FIG. 1, only one solenoid 138 is shown but the reader should regard this solenoid as in fact consisting of whatever number of solenoids are required to deactivate a predetermined number of engine cylinders under selected conditions of engine or vehicle operation. For example, in the present embodiment, a six-cylinder engine is to have three of its cylinders disabled and, with the mechanism illustrated in FIG. 3, the solenoid 138 should be regarded as actually consisting of three parallel-connected solenoids capable of disabling three of the engine cylinders by closing the respective intake and exhaust valves of such cylinders. Of course, it is possible to disable an engine cylinder by closing only its intake valve, but it is more desirable to close both the intake and exhaust valves because this results in less energy dissipating within the disabled cylinder. The closing of the exhaust valve traps whatever gasses remain in the cylinder at the time of its disablement and permits this gas to be alternately compressed and expanded during engine operation powered by the cylinders not disabled. Energy losses in the disabled cylinder then are limited primarily to frictional losses.

With particular reference again to FIG. 1, and to the output circuit 14 therein, it may be seen that the solenoid 138 is energized when a logic one level signal appears on the lead 15 forming the input to the circuit 14. A logic one level signal appearing on lead 15 supplies the base-emitter current required to switch the transistor 120 into a conductive state. This energizes the relay coil 122 and causes its switch 126 to close. As a result, the supply voltage on lead 34 is applied to junction 128 and relay coil 132 is immediately energized through the capacitor 130, which acts as a low impedance path at this time. Energization of the relay coil 132 causes its switch 136 to close and this supplies the voltage at junction 128 to terminal 27 connected to the solenoid 138, which then becomes energized. The solenoid 138 then has its movable member actuated to disable three of the six cylinders in the engine. Once the solenoid 138 has been energized, the current level required to maintain it in its actuated condition is less than that required for initial actuation, and it is desirable to reduce the current level in the solenoid 138 in order to reduce its power dissipation and the heating effects associated therewith.

Once the voltage of supply lead 34 is applied to the junction 128, the relay coil 132 is energized as previously described and the capacitor 130 begins to charge through this relay coil. As the capacitor 130 continues to charge, the current flow through the coil 132 decreases to the point at which this relay coil no longer is able to maintain the switch 136 in a closed condition. As a result switch 136 opens after a predetermined time interval and the resistor 142 no longer is bypassed by the switched 136. Current then flows from the junction 128, through the resistor 142, to the terminal 27 and from there through the solenoid 138 to the ground lead 28. This inserts the impedance 142 in series with the solenoid 138 reducing the current flow and power dissipation in the solenoid 138. Of course, the relay circuitry illustrated in FIG. 1 for reducing the power dissipation in the solenoid 138 may be replaced by solid state circuit means, for example, in the manner hereinaftr described in connection with the circuit of FIG. 2 or in an analogous manner.

From the preceding paragraphs, it is clear that the engine's three cylinders are disabled whenever a logic one level signal appears on output lead 15 of the circuit 12. The manner in which this logic one level signal is obtained or removed is described in the paragraphs which follow.

The function of the circuit 12 is to produce a logic one level signal on lead 15 to energize the solenoid 138 if the engine speed is greater than 1700 rpm (which may correspond to 45 mph), if the intake manifold vacuum level is greater than 229 mm Hg, and if the vehicle's transmission is in third gear. Once the solenoid 138 has been energized to disable three of the engine's six cylinders, it is desired to have the circuit 12 once again enable the three nonoperative cylinders if the engine's speed is not greater than 1500 rpm (which may correspond to 40 mph), and if the manifold vacuum at the same time is not greater than 229 mm Hg. Also, the three disabled cylinders are to be rendered operative once again if the intake manifold vacuum level is not greater than 38 mm Hg or if the transmission is not in third gear or if the engine's speed is not greater than 950 rpm (which may correspond to 25 mph).

A logic one level signal can appear on the output lead 15 of the circuit 12 only if both of the inputs to the NOR-gate 112 are logic zero level signals.

Let it be assumed that the driver of the vehicle, in which the engine utilizing the circuit 10 is employed, has just started the engine and that the engine is idling at 600 rpm with the vehicle transmission in its low-gear condition. In such circumstances, the output of the NOR-gate 112 is a logic zero level. As the driver accelerates the vehicle, the logic zero level signal on the lead 15, the output of NOR-gate 12, remains at the logic zero level until, simultaneously, the vehicle's transmission is in third gear, the engine's speed becomes greater than 1700 rpm and the engine's intake manifold vacuum is greater than 229 mm Hg.

Typically, the engine's speed will exceed 950 rpm as the vehicle is accelerated in the lower gears. This causes the logic zero level to appear on lead 20, which signal is inverted by the NAND-gate 108 and results in the application of a logic one level signal to the center input of the NAND-gate 106. Now, if the vehicle's transmission is in third gear and if the intake manifold vacuum level is greater than 38 mm Hg, then, and only then, will a logic one level signal appear at the output of the NOR-gate 104 and be applied to the upper input of the NAND-gate 106. Under moderate engine loads, this condition occurs when the engine's speed is less than 1700 rpm in third gear. If the lower input signal to the NAND-gate 106 reaches a logic one level when the other two inputs thereof are at such level, then a logic zero level appears at the output of the NAND-gate 106. A logic one level appears at this lower input, which is the output of the NAND-gate 110, if either the engine's speed becomes greater than 1700 rpm or if the engine's intake manifold vacuum becomes greater than 229 mm Hg. In the operation of the circuit 10, which of these two conditions occurs first is of no consequence, but it may be assumed that the manifold vacuum exceeds 229 mm Hg before the engine's speed reaches 1700 rpm with the vehicle's transmission in third gear. This produces a logic zero level signal at the output of the NAND-gate 106, which forms one of the inputs to the NOR-gate 112.

With the engine's speed still below 1700 rpm, a logic one level signal exists on the lead 18 of the engine's speed responsive switching circuit 16. The capacitor 105, through the resistor 103, will have charged to this logic one voltage level so that a logic one level signal appears on the leads connected to the junction formed between the resistor 103 and the capacitor 105. When the engine's speed exceeds 1700 rpm, lead 18 assumes the logic zero level previously described. The capacitor 105 then discharges through the resistor 103 and the switching circuit 16, and the leads connected to the junction formed between the resistor 103 and the capacitor 105 assume a logic zero level.

As a result, the NOR-gate 116 produces a logic one level signal at its output when the engine's speed exceeds 1700 rpm, but only if at the same time the manifold vacuum level is greater than 229 mm Hg. This logic one level signal at the output of NOR-gate 116 is applied to one of the inputs to the NOR-gate 114. Prior to the occurrence of this logic one level on the output of the NOR-gate 116, the NOR-gate 114 has a logic one level signal at its output, which is applied as one of the inputs to the NOR-gate 112. When the logic one level signal occurs at the output of the NOR-gate 116, both of the inputs to the NOR-gate 112 are logic zero level signals and this produces a logic one level signal at the output of the NOR-gate 112 and results in energization of the solenoid 138 in the manner previously described.

The engine's speed responsive switching circuit 16 includes hysteresis elements which act to reduce the engine speed level required to change the logic zero level signal on lead 18 to a logic one level signal. This hysteresis circuit, preferably, is designed such that the change from a logic zero level signal to a logic one level signal on lead 18 does not occur unless the engine speed falls below 1500 rpm. If the engine's speed falls below 1500 rpm and if the manifold vacuum becomes less than 229 mm Hg, then the output of the NOR-gate 116 returns to a logic zero condition, resulting in the appearance of a logic one level signal at the output of the NOR-gate 114. When this occurs, the NOR-gate 112 output on lead 115 changes from a logic one level to a logic zero level resulting in de-energization of the solenoid 138 and a return of the vehicle's engine to six-cylinder operation.

If the vehicle's transmission is shifted out of third gear or if the engine's intake manifold vacuum becomes less than 38 mm Hg, then a logic zero level appears at the upper input to the NAND-gate 106 resulting in a logic one level at the output of this NAND-gate. A logic one level at the output of the NAND-gate 106 produces a logic zero level on lead 15 again resulting in de-energization of the solenoid 138 and a return to six-cylinder operation. Similarly, if the engine speed falls below 950 rpm, a logic one level signal appears on lead 20 and is inverted by the NAND-gate 108 to produce a logic zero level at one of the inputs to the NAND-gate 106, a logic one level at the output of this NAND-gate and a logic zero level on lead 15, again resulting in de-energization of the solenoid 138 and a return to six-cylinder operation.

The primary function of the resistor 103 and the capacitor 105 is to prevent oscillation when the engine shifts from three cylinder to six-cylinder operation. When the engine shifts from three-cylinder operation to six-cylinder operation, there is a pumping action in the engine that tends to produce a transient and substantial increase in the engine's intake manifold vacuum. This causes the spark timing in the engine to be advanced in a conventional engine equipped with a distributor vacuum advance mechanism. The increase in spark advance is sensed by the engine's speed responsive switching circuit 16 as a result of its connection to the ignition coil 38, and is interpreted as an increase in engine speed. With high manifold vacuum and an indicated increase in engine speed, this could be interpreted by the circuit 10 as an indication that three-cylinder operation is required. Were the engine then to shift three-cylinder operation, the circuit then would determine that six-cylinder operation is required and the process would be repeated to produce oscillatory shifting from three-cylinder operation to six-cylinder operation and back again. The components 103 and 105 constitute circuit means for preventing this from occurring because the capacitor 105 must be discharged to a low voltage level before the engine can be shifted to three-cylinder operation.

In the voltage supply, signal source and logic circuit 12, resistors 94, 98 and 102 perform a current limiting function and in association, respectively, with capacitors 97, 99 and 101, provide an RC noise filter function to prevent transient signals from causing a switch from six-cylinder operation to three-cylinder operation or vice versa at times other than when such switching is desired. Capacitors 74, 80 and 90 are ignition system transient discharge capacitors intended to prevent transient ignition system signals from causing malfunction of the logic circuitry.

Diode 91, connected in parallel with the resistor 93, and the associated capacitor 95 form a time delay circuit. These circuit components are intended to prevent the changing of the vehicle's engine from six-cylinder operation to three-cylinder operation when the transmission, particularly a manual transmission, is shifted to third gear from a lower gear. On a manual transmission vehicle, a clutch is depressed when the gear change is effected. This reduces the engine load and increases its speed and manifold vacuum level. With the clutch depressed, the manifold vacuum may exceed 229 mm Hg with the engine's speed above 1700 rpm and the transmission in third gear. These conditions then would cause the engine to shift from six-cylinder operation to three-cylinder operation during the gear change process. However, with the components 91, 93 and 95 this is prevented; the capacitor 95 is charged to the voltage of supply lead 34 through the resistor 70 and diode 91 if the transmission is in a position other than third gear, in which case the switch 72 is in an open condition. When the switch 72 closes during the change to a third gear position, terminal 21 is connected to ground potential and the capacitor 95 discharges through the resistor 93 with a time constant of 2.2 seconds. As a result, some time must elapse before a logic zero level signal appears at the input lead 92 of NOR-gate 104. This time delay permits the depressed clutch to be released so that the logic circuitry may respond to actual engine speed and load conditions that occur with the clutch engaged. The components 91, 93 and 95 thus constitute means for preventing a reduction in the number of operating cylinders for a predetermined time interval subsequent to the occurrence of an event required to effect a reduction in the number of operating engine cylinders.

The capacitors 115 and 117 in the circuit 12 are provided for the purpose of noise suppression. The different capacitance values are related to the different lengths of the respective output leads of the NOR-gates 112 and 114.

With particular reference now to FIG. 2, it may be seen that the voltage supply, signal source and logic circuit 12 therein is identical to the circuit 12 in FIG. 1, but that the output circuit 143 in FIG. 2 differs considerably from the output circuit 14 of FIG. 1.

The output circuit 143 in FIG. 2 is intended to control the operation of two groups of solenoids 194 and 196. Each time the signal on lead 15 changes from a logic zero level to a logic one level, either the group of solenoids 194 or the group of solenoids 196 is energized. Solenoid group 194 controls the disablement of three cylinders of the engine and the solenoid group 196 controls the disablement of the other three cylinders of the engine. If the solenoid group 194 was the last group to have been energized, then when three cylinder operation is again called for as indicated by the appearance of a logic one signal on lead 15, the solenoid group 196 is energized. Thus, the solenoid groups 194 and 196 are alternatingly energized as a result of transistions from a logic zero state to a logic one state at lead 15.

Lead 15 is connected to the input of a NAND-gate inverter 144 whose output is connected to a dual-type D flip-flop 200 and, through a capacitor 146 and a resistor 148, to the voltage supply lead 34. The junction formed between the capacitor 146 and resistor 148 is connected through a resistor 150 to one input of a NAND-gate 152, the other input of which is connected through a resistor 154 to the junction formed between one terminal of a resistor 156 and the cathode of a diode 160 connected in parallel with the resistor 156. The anode of the diode 160 is connected to the junction formed between the resistor 156 and a resistor 158. The output of the NAND-gate 152 forms one of the inputs of a NAND-gate 164 whose output is connected to one terminal of a capacitor 162, the opposite terminal of which is connected to the junction formed between the components 154, 156 and 160. Resistor 158 also has one of its terminals connected to the output of the NAND-gate 152.

Circuit components 150, 152, 154, 156, 158, 160, 162 and 164 comprise an oscillator for generating a pulsating signal on its output lead 165 following the occurrence of a logic one level signal on lead 15. The circuit components 148 and 146 provide a time delay that occurs upon the appearance of a logic one level signal on lead 15. This time delay results in the maintenance of a logic zero level signal on the lead 165 for a predetermined time interval. Subsequent to this time delay, the signal on lead 165 oscillates between logic zero and logic one levels. The purpose of the time delay is to permit the solenoid groups 194 or 196 to be energized and thereafter to reduce the average current level therethrough by providing a pulsating voltage to the energized solenoid group, thereby, to reduce its power dissipation. During the oscillatory function, capacitor 162 is repeatedly charged and discharged in opposite directions through the components 156, 158 and 160. In the absence of the diode 160, the signal on lead 165 would have a 50% duty cycle, but with the diode 160, resistor 156 is bypassed during part of the oscillatory cycle. Thus, the signal on lead 165 may be maintained at a logic zero level, for, for example, 30% of the period of the oscillatory signal. This is sufficient to maintain either of the solenoid groups 194 or 196 in an energized state.

The dual flip-flop 200 is connected such that its outputs Q2 and $\overline{Q2}$ alternate between logic zero and logic one levels in response to a transition from a logic zero level to a logic one level on lead 15. In other words, in response to such a transistion on the lead 15, the Q2 output of the dual flip-flip 200 may go to a logic zero level and the $\overline{Q2}$ output to a logic one level, and upon the next transition from a logic zero level to a logic one level on lead 15, the Q2 output of the dual flip-flop 200 would go to a logic one level and its $\overline{Q2}$ output would go to a logic zero level. The transitions on the Q2 and $\overline{Q2}$ outputs of the dual flip-flop 200 occur upon the positive-going edge of pulses produced at the $\overline{Q1}$ output of the dual flip-flop, which output is connected to the C2 input.

The output of the inverter 144 is the complement of the signal appearing on lead 15 and is applied to the S1 input of the dual flip-flop 200. The series-connected resistor 202 and capacitor 204 provide a time delay function that prevents oscillations that might occur on the lead 15 from affecting the signals appearing on the Q2 and $\overline{Q2}$ outputs of the flip-flop 200. These transient oscillations on lead 15 may result from a toggling action during logic circuit switching to a condition requiring three-cylinder operation.

The $\overline{Q2}$ output of the flip-flop 200 is one of two inputs to the NOR-gate 166, whereas the Q2 output of the flip-flop 200 is one of two inputs to a NOR-gate 168. The other inputs to the NOR-gates 166 and 168 are the signal appearing on the lead 165. When a logic zero level occurs on the lead 165, one of the solenoid groups 194 or 196 is energized. If the $\overline{Q2}$ output of the flip-flop 200 is at a logic zero level, then a logic one level appears at the output of the NOR-gate 166 and the solenoid group 194 is energized to disable the three cylinders associated with it. On the other hand, if the Q2 output of the flip-flop 200 is at a logic zero level, then the output of the NOR-gate 168 is at a logic one level causing the solenoid group 196 to be energized to disable the three cylinders of the engine associated with this group of solenoids.

The outputs of the NOR-gate 166 is connected through a current limiting resistor 170 to the base of a transistor 174 whose collector is connected through a current-limiting resistor 172 to the voltage supply lead 34 and whose emitter is connected to ground. The collector of the transistor 174 also is connected through a current-limiting resistor 176 to the base of a transistor 178 whose emitter is connected to the voltage supply lead 34 and whose collector is connected to the solenoid group 194. A field dissipation diode 180 has its cathode connected to one side of the solenoid group 194 and has its anode connected to ground. An identical circuit, including a current-limiting resistor 182, resistors 184 and 186, transistors 188 and 190 and a diode 192 is connected to the solenoid group 196 and is controlled by the NOR-gate 168. It should be noted that lead 198 is a ground lead.

The appearance of a logic one level signal at the output of the NOR-gate 166 turns on the transistor 174 providing the emitter-base current drive for the transistor 178. This results in the full conduction of the emitter-collector circuit of the transistor 178 supplying current to the group of solenoids 194. On the other hand, when a logic one level signal appears at the output of the NOR-gate 168, transistors 188 and 190 are rendered conductive to cause current to flow through the solenoid group 196. Thus, either solenoid group 194 or group 196 is energized depending, respectively, upon whether or not a logic one level signal appears at the output of the NOR-gate 166 or at the output of the NOR-gate 168.

The preferred form of the engine speed responsive switching circuit 16 is illustrated in FIG. 4. The circuit 16 includes a Motorola MC14528 dual monostable multivibrator 270. This dual, retriggerable, resettable monostable multivibrator is triggered by the positive-going edges of pulses applied to its trigger inputs $A_A$ and $A_B$ via lead 272, which is the output lead from an inverter 274, that inverts the pulse signals 56 appearing on lead 58. The subscripts A and B correspond, respectively, to the two monostable multivibrators in the package 270. Thus, each multivibrator receives pulses on lead 272 having a frequency proportional to engine rpm.

The circuit 16 also includes a Motorola MC14015 dual four-bit static shift register 276. The subscripts A and B associated with the shift register 276 correspond, respectively, to each of the four-bit static shift registers in the package 276. These identical shift registers are of the serial-input/parallel-output type and each shift register has independent clock (C) and reset (R) inputs with a single serial data (D) input. Data is shifted from one stage to the next during the positive-going clock transition, and each register can be cleared with a logic one level signal applied to its reset terminal.

One of the monostable multivibrators in the package 270 has timing components, including a capacitor 278, a resistor 280, a resistor 82, and a blocking diode 84, that determine the duration of the output pulse appearing on its output lead 286. This output lead 286 is connected between the $Q_A$ output of the multivibrator 270 and the data input $D_A$ of one of the shift registers in the package 276. When the output signal on lead 18 is at a logic one voltage level, substantially equal to the supply voltage +V, the diode 84 is forward biased and the resistor 82 and diode 84 are connected in parallel with the resistor 280. On the other hand, when the voltage on output lead 18 is low or at ground potential (a logic zero level), the diode 84 is reverse-biased and the timing circuit for the associated monostable multivibrator in the package 270 effectively includes only the resistor 280 and the capacitor 278, which increases the duration of the $Q_A$ output pulse appearing on lead 286.

The timing circuit associated with the second monostable multivibrator in the package 270 includes a resistor 288 and a capacitor 290. The output pulses appear on lead 292 interconnecting the $Q_B$ output of the package 270 with the data input $D_B$ of the second shift register in the package 276.

Leads 294, 296 and 298 connect, respectively, the $Q0_A$ $Q1_A$ and $Q2_A$ bit outputs from one of the shift registers in the package 276 to a NAND-gate 300 having the output lead 18. Similarly, the leads 302, 304 and 306 connect, respectively, the $Q0_B$, $Q1_B$ and $Q2_B$ bit output leads from the other shift register in the package 276 to the inputs of a NAND-gate 308 having the output lead 20. A capacitor 310 is connected in seris with the resistor 312, and these components are connected between the +V supply voltage appearing at junction 68 and ground potential on lead 66. The junction between the capacitor 310 and the resistor 312 is connected by leads 314 and 316 to the respective reset terminals $R_A$ and $R_B$ of the dual shift register package 276.

With respect to the operation of the switching circuit 16, let it be assumed that the ignition switch 32 is initially open as shown and that the engine is not running. Upon closure of the ignition switch 32 and starting of the engine, pulses begin to appear on the lead 272 in the circuit 16. These pulses have a frequency directly proportional to engine speed and a period inversely proportional thereto. The closure of the ignition switch 32 produces the +V voltage at junction 68 and, because the capacitor 310 is initially discharged, the same voltage initially appears on leads 314 and 316 to reset the dual shift registers in the package 276 so that the bit outputs on leads 294, 296, 298, 302, 304 and 306 are at logic zero levels. The capacitor 310 charges through the resistor 312 and, thereafter, leads 314 and 316 are maintained at ground potential.

As the engine speed increases, the period of the pulses on lead 272 decreases. The positive going edge of each pulse thereon retriggers both of the monostable multivibrators in the package 270. With the timing circuit component values indicated in the drawing for the B-multivibrator in the package 270, the signal on lead 292 that is applied to the $D_B$ input of the B-shift register in the package 276 is always at a logic zero level when the positive going edge of a pulse on lead 272 is applied to the $C_B$ input of this shift register, provided that the engine speed is less than 950 rpm. This occurs because the timing circuit components 288 and 290 produce a pulse duration on lead 292 that is less than the period of the input signal appearing on lead 272, and, hence, a logic zero level signal is transferred from the $D_B$ input of the B-shift register in the package 276 to its $Q0_B$ location each time a pulse appears on the lead 272. As a result, leads 302, 304 and 306 have logic zero level signals on them, and the output lead 20 has a logic one level signal on its, as long as the engine rpm is less than 950.

When the engine speed exceeds 950 rpm, the pulses appearing on lead 272 retrigger the B-monostable multivibrator before the timing components 288 and 290 permit termination of the high voltage level of the signal on lead 292, which lead therefore is maintained at a logic one level at engine speeds above 950 rpm. After three positive-going edges have appeared on lead 272, the logic one level signal on lead 292 will have been shifted by the B-shift register in the package 276 to its $Q0_B$, $Q1_B$ and $Q2_B$ outputs so that logic one level signals appear on leads 302, 304 and 306. This causes a logic zero level signal to appear on the switching circuit output lead 20.

With the timing components 278, 280, 82 and 84 associated with the A-monostable multivibrator in the package 270 and with the engine speed less than 1700 rpm, the duration of the pulses appearing on lead 286 is less than the period of the signal appearing on lead 272. However, at engine speeds in excess of 1700 rpm, the A-monostable multivibrator in the package 270 is retriggered at a frequency that results in the lead 286 being maintained at a logic one level. As a result, the $D_A$ input in the A-shift register of the package 276 remains at a logic one level, and, upon the occurrence of three positive-going edges of the pulses appearing on lead 272, which are applied to the clock input $C_A$, logic one level signals appear on leads 294, 296 and 298. This causes the appearance of a logic zero level signal on the lead 18. When the logic zero level signal appears on lead 18, the diode 84 is reverse-biased and this diode and the resistor 82 effectively are removed from the timing circuit associated with the A-monostable multivibrator of the package 270 so that the engine speed then must fall below 1500 rpm in order for the output signal on lead 18 to once again reach a logic one level. Thus, the components 84 and 82 perform a hysteresis function with regard to the timing circuitry associated with the A-monostable multivibrator in the package 270 and, hence, with regard to the frequency of the signal at input terminal 22 that is required to produce a switching action at output lead 18.

It should be noted that the leads 286 and 292 must be maintained at logic one levels for three positive-going edges of the signal appearing on lead 272 in order for the respective output leads 18 and 20 to change from a logic one level to a logic zero level. However, only one logic zero level signal on the lead 286 or 292 is required to cause the signal of the associated output leads 18 or 20, respectively, to change from the logic zero level to the logic one level. This is because the positive-going edge of a pulse on lead 272 causes the logic zero level on either of leads 286 and 292 to transfer a logic zero level bit into the $Q0_A$ or $Q0_B$ bit outputs of the package 276. Any logic zero signal on the leads 294, 296 or 298 results in a logic one level at output lead 18 and, similarly, any logic zero level signal on the leads 302, 304 or 306 produces a logic one level signal on output lead 20.

Components 82 and 84 in the circuit portion 12 of FIG. 2 actually are a part of the engine speed responsive switching circuit 16 hereinafter described and correspond to identically numbered components shown in FIG. 4. In the circuit of FIG. 4, the anode of the diode 84 is connected to lead 18, one of the output leads of the engine speed responsive switching circuit 16. However, in the circuit of FIG. 2, it is preferred that the anode of the diode 84 be connected to the output of the inverter 144.

The circuit component values and type numbers are provided to exemplify, but not to limit, the invention. Various circuit modifications may be made without departing from the spirit and scope of the invention. For example, if the input signal 48 is characterized by excessive ringing or high voltage spikes, it may be desirable to connect a zener diode between terminal 22 and resistor 50 to prevent the occurrence of false trigger signals on leads 58 and 272. If such a zener diode is used, resistor or other means may be connected in parallel with zener diode 52 and capacitor 54 to couple lead 58 to ground potential when the added zener diode is in a nonconductive state.

What is claimed is:

1. In a system for controlling the operability of one or more cylinders of a multicylinder internal combustion engine, said system including:

(a) electrically controllable means for disabling at least one cylinder of said internal combustion engine;

(b) circuit means for sensing a plurality of conditions of operation of said engine;

(c) logic circuit means, responsive to said sensing circuit means, for generating electrical signals for controlling the energization and de-energization of said disabling means; and (d) output circuit means, coupled between said logic circuit means and said disabling means, for controlling electrical energy supplied to said disabling means in response to said electrical signals generated by said logic circuit means;

the improvement which comprises:

(e) means for preventing oscillatory energization and de-energization of said disabling means which may otherwise occur from transient conditions of engine operation that result from a change of said disabling means from an energized state to a de-energized state or vice versa.

2. A system according to claim 1 wherein said means for preventing oscillatory energization and de-energization of said disabling means comprises means for delaying a change in the level of a logic signal applied to said logic circuit means in response to a change in a condition of operation of said engine sensed by said sensing circuit means.

3. A system according to claim 2 wherein said engine has an intake manifold, wherein said sensing circuit means produces an electrical signal when the level of intake manifold vacuum exceeds a predetermined level, wherein said sensing circuit means produces an electrical signal when the speed of rotation of said engine exceeds a predetermined level, said electrical signals generated by sensing circuit means being supplied to said logic circuit means, and wherein said delaying circuit means delays the application to said logic circuit means of said electrical signals generated by said sensing circuit means.

4. In a system for controlling the operability of one or more cylinders of a multi-cylinder internal combustion engine, said system including:

(a) electrically controllable means for disabling at least one cylinder of said internal combustion engine;

(b) circuit means for sensing a plurality of conditions of operation of said engine;

(c) logic circuit means, responsive to said sensing circuit means, for generating electrical signals for controlling the energization or de-energization of disabling means; and (d) output circuit means, coupled between said logic circuit means and said disabling means for controlling electrical energy supplied to said disabling means in response to said electrical signals generated by said logic circuit means;

the improvement which comprises:

(e) said output circuit means comprising an oscillator circuit and a time delay circuit, said oscillator circuit having an input coupled to said time delay circuit and having an output coupled to said disabling means, said oscillator circuit comprising a first gate element, a second gate element, a capacitor, and resistance means, said first gate element having an input coupled to said time delay circuit and having an output coupled to an input of said second gate element, said second gate element being coupled to said capacitor and to said resistance means, said capacitor and said resistance means controlling the pulse duration and frequency of the oscillatory signal produced by said oscillator circuit, and said time delay circuit preventing oscillations from occurring at the output of said oscillator circuit for a predetermined time interval subsequent to the generation by said logic circuit means of an electrical signal for causing said disabling means to change from a de-energized state to an energized state.

5. A system according to claim 4 wherein said oscillator circuit includes a diode connected in parallel with a portion of said resistance means, said diode producing a duty cycle in the oscillatory signal produced by said oscillator circuit that is other than 50%.

* * * * *